United States Patent [19]

Bogren

[11] Patent Number: 4,556,152

[45] Date of Patent: Dec. 3, 1985

[54] TEAR OPENING MEANS FOR CONTAINERS

[75] Inventor: Ingemar S. B. Bogren, Sigtuna, Sweden

[73] Assignee: Esselte Pac Aktiebolag, Jarfalla, Sweden

[21] Appl. No.: 694,827

[22] PCT Filed: May 15, 1984

[86] PCT No.: PCT/SE84/00179

§ 371 Date: Jan. 7, 1985

§ 102(e) Date: Jan. 7, 1985

[87] PCT Pub. No.: WO84/04511

PCT Pub. Date: Nov. 22, 1984

[51] Int. Cl.[4] ..... B65D 17/40

[52] U.S. Cl. ..... 220/276; 220/270; 220/258

[58] Field of Search ..... 220/266, 269, 270, 276, 220/260, 258; 206/498, 601-634; 229/43

[56] References Cited

U.S. PATENT DOCUMENTS 3,159,303 12/1964 Betner ..... 220/270
3,195,763 7/1965 Fried et al. ..... 220/270
3,220,599 11/1965 Fried et al. ..... 220/270
4,513,876 4/1985 Buchner ..... 220/270

*Primary Examiner*—George T. Hall
*Attorney, Agent, or Firm*—James E. Nilles

[57] ABSTRACT

An opening means for containers especially powder proof, liquid proof or gas proof containers of the type which at least at one end is closed by means of an end closure (2) providing an openable end panel (3) which for instance over a sealing edge (4) sealingly engages the container sleeve and in which the end closure is punched through along a line (6) of the end panel (3) extending some distance inside of the sealing edge (4). At the lower surface the end panel (3) carries a sealing foil (12) of a weldable or solderable material which is welded or soldered to the end panel (3) so as to seal the through punching (6) of the end panel (3). The end panel (3) is made of a material having higher shearing strength than that of the material of the lower sealing foil, so that the container can be opened along a sharp line corresponding to the through punching (6) of the end panel (3). For facilitating the opening of the container the end panel (3) may be formed with a tearing tongue or any other means, by which the container can be opened.

7 Claims, 7 Drawing Figures

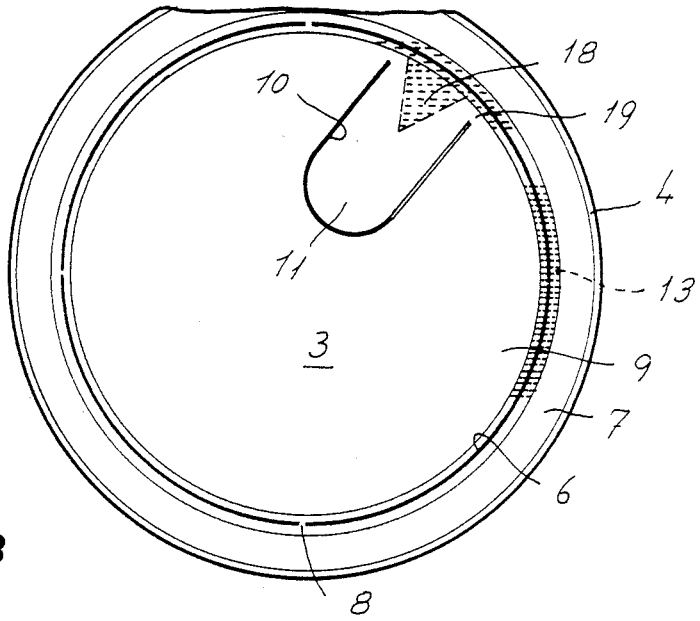
Fig. 3
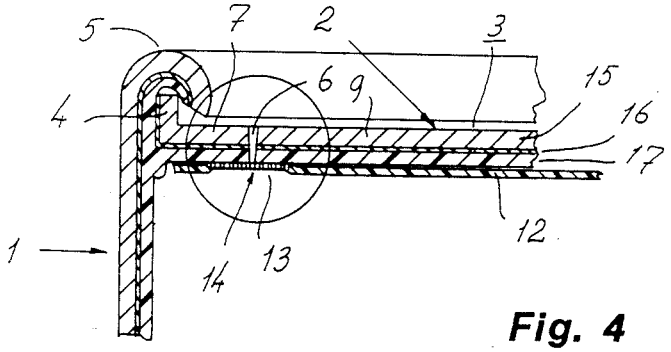
Fig. 4
Fig. 5
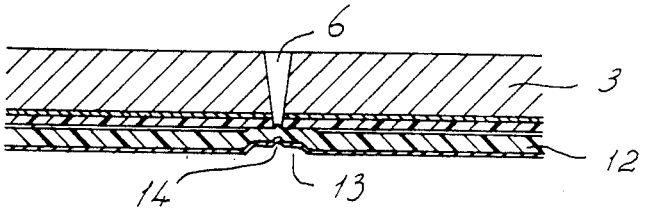

TEAR OPENING MEANS FOR CONTAINERS

The present invention relates to an opening means for containers, especially powder proof, liquid proof or gas proof containers of the type which at least at one end is closed by means of an end sealing providing an openable end panel which for instance by a sealing edge is sealingly connected to the container.

The invention has been made especially in connection to the development of a tin like container of cardboard having an inner end sealing, and in which both the container sleeve and the end sealing on the meating surfaces are formed with a weldable material, especially a plastic material, and in which the end sealing is liquid proof or gas proof connected to the container sleeve by means of ultrasonic or high frequence welding. It is, however, obvious that the invention is useful for many other types of container which are powder proof, liquid proof or gas proof, whether or not the material of the container sleeve or the end sealing is cardboard, plastic, sheet metal or any other material.

The container sleeve preferably should be made of a relatively stiff material whereas the end sealing may be stiff or easily foldable having a body of cardboard, stiff or soft plastic, paper parchment or any other suitable mmaterial. In order to make it possible to open the end sealing in containers of the above mentioned type the container sleeve and the end sealing used to be formed, so that the opening is made in that the end sealing is cut through by means of a tool, preferably close to the container sleeve. For cutting the end sealing through there is a need of supply for the said tool, it may be difficult to cut through certain materials, generally a rough opening edge is obtained, and the upper edge of the container gets a reduced stability in that the interconnecting end sealing is completely removed.

For making it more easy to open the container it has been suggested that the end sealing is formed with a tear open means, for instance a wire of a material having a sufficient tearing strength and which when being torn is cutting the end sealing through thereby opening the container. Such wires must be formed so that the cutting through of the end sealing is made continuous adjacent the wall surface of the container sleeve by tearing the wire in the clockwise or the counter clockwise direction. Such a tearing open of the end sealing may be hard or difficult. The tearing wire or the tearing strip also may brake during the tearing operation. The tear open means generally is formed for right-handed people and provides problem for left-handed people, it often gives a rough and uneven tearing edge, and the manufacture of the tear open means generally involves a complicated and expensive manufacturing step in the manufacture of the container. A special type of tear open means is known from our own U.S. Pat. No. 3,776,450, in which the end sealing comprises two foils of a plastic material especially a laminated luminum plastic material, in which the foils are substantially the same type, and in which the upper foil is punched through, both to provide a handle tongue and for providing an even tearing edge and in which the lower foil is punched through to provide an arrow point like formation intended to provide a tearing start point, and in which the lower foil is welded to the upper foil round the tearing line extending round the upper foil and round the arrow point like tearing start point of the lower foil.

Such an end sealing having a tear open means allows a simple opening of the container by tearing off the combined plastic foils, and generally it gives an even tearing edge. Also this type of tear open means, however, is only adapte to right-handed people or alternatively to lefthanded people and depending on the rather complicated punchings of the two foils and the welding together thereof it is complicated and rather expensive to manufacture.

All of the above mentioned previously known tear open means are formed so that the tearing wire or any other tear open assisting means must be glued or welded to the end sealing in a slow and thereby expensive separate operation. According to modern techniques it is a wish that any welds etc. of the tear open means are provided by means of high frequence welding or ultrasonic welding in ne and the same operation. In the known tear opening means any welds generally are not suited for high frequence welding or ultrasonic welding, or they may be designed so that they require complicated or expensive welding tools or so that the welding must be made in several successive operation steps.

The object of the invention therefore has been to solve the problem of providing an opening means for end sealing of a container of the above mentioned type in which the end sealing may be welded or in any other way secured to the inner surface or possible the outer surface of the container tube, and in which the opening means is designed so as to provide a simple and complete opening by seizing and tearing a tearing tongue or a similar means straight upwards thereby providing a complete opening of the container giving an even and smooth opening edge, and in which the opening means is useful both for right-handed and left-handed people, in which the tear opening means may be provided quickly and simply and in which any welds can be made by high fequence welding or ultrasonic welding in one single quick operation. Preferably the opening means should be designed so that it can be provided anywhere of the end sealing and also preferably so as to leave an edge adjacent the container sleeve which edge provides a stabilizing of the open end of the container after having been opened.

According to the invention the end sealing is punched through along a line of the end panel extending some distance inside of the sealing edge, and the end panel carriers at the underside thereof a sealing foil of a weldable or solderable material which is welded or soldered to the end panel so as to provide a sealing of the punchings of the end panel. Also the end panel is made of a material having a higher strength, especially a higher shearing strength than the material of the lower sealing foil, the end panel is formed with means for providing an opening of the container by tearing up the end panel and the sealing foil along the punching of the end panel.

By strength is meant in this connection that the end panel should have a shearing strength combined with the greater thickness of material which is that much greater than the corresponding shearing strength and material thickness of the lower sealing foil that a tearing of a part of the end panel releases the end panel and at the same time provides a tearing open of the sealing foil.

The through punching of the end panel is made as a continuous or discontinuous line, and the sealing foil may be attached to the end panel or top panel along a continuous joining line of even width, and the interconnecting of the end panel and the sealing foil may quickly and simply be provided by means of high frequence ultrasonic welding. When welding or soldering the sealing foil to the end panel the joining line and especially part of the joining line corresponding to the through punching of the end panel provides a starting point of breaking the sealing along which the tearing opening is made. Since the sealing foil is made of a material having less shearing strength than the material of the end panel the said sealing foil is being sheared off against the edge of the end panel when tearing up the end panel and the risk that the end is broken apart before the sealing foil is torn open is eliminated. The tearing tongue of the end panel may be provided anywhere and is preferably designed so as to extend in the radial direction, whereby the container is opened by tearing the tongue straight up. The end closure or end panel and sealing foil respectively may be made of many different types of material. The end closure or end panel can be hard and may consist of cardboard, hard plastic, metal plate or any other type of stiff laminated material, but it can as well be soft and may consist of plastic, paper, parchment or any other suitable material. The essential point of the invention is that the end panel is made of a material having a higher shearing strength than the shearing strength of the material of the sealing foil, and for this purpose the foil may consist of paper, parchment, plastic etc.

Further characteristics of the invention will be evident from the following detailed specification in which reference will be made to the accompanying drawings.

In the drawings

FIG. 3 shows the end closure from above.

FIG. 4 is a vertical cross section through a part of the container according to FIG. 1 and FIG. 5 is a cross section in a large scale of the incircled part of FIG. 4.

Figure 1:
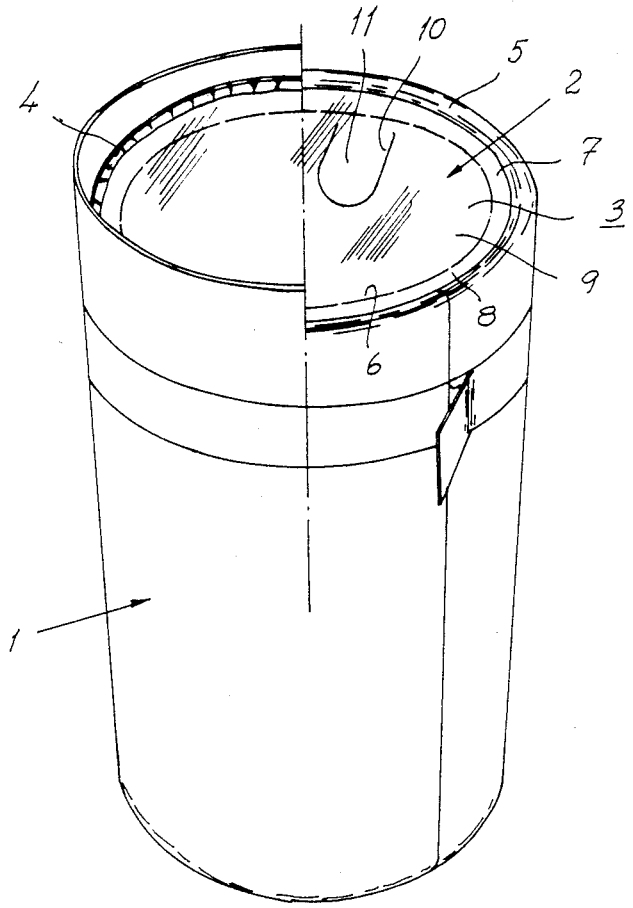
FIG. 1 is a persective view of the container having an end closure according to the invention and FIG. 2 likewise is a perspctive view only of the end closure of the container.
Figure 2:
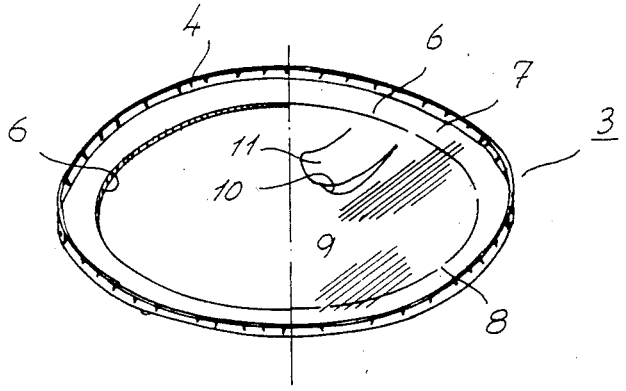

The container shown in FIG. 1 comprises a container sleeve 1 having an end closure at both ends, of which only the top closure is visible. The container sleeve may be made of a cardboard material which at the inner side is formed with a laminate of aluminum and a weldable plastic, for instance polyethylene. The top closure 2 is formed as an uneven top panel 3 and from the top panel a projecting edge 4 which is welded, soldered, glued or in any other way attached to the inner surface of the container sleeve 1. The left part of FIG. 1 shows the container tube in a state when the container is not yet ready whereas the right of FIG. 1 shows the ready container, whereby the upper edge of the container sleeve has been curled inwards so as to provide a reinforcing and attractive curled edge 5. As previously mentioned the top closure may consist of a stiff or uneasily foldable material, and for providing a tearing open of the container the top panel 3 is punched through along a substantially continuous line 6 extending on some distance inside of the top panel edge 4 so that the top panel gets a remaining horizontal support edge 7 after having been torn open which support edge 7 stabilizes the open container end. The through puching 6 is interrupted by some narrow nonpunched part or hinges 8 the purposes of which only is to keep the lid panel 9 appearing inside of the punch line 6 to the remaining parts of the top closure. The number of nonpunched parts or hinges may be two or more. The central lid panel further is formed with a U-formed punching 10 intended to provide a tearing tongue 11. The U-punching 10 preferably extends with parallel branches in the direction radially outwards and so that said branches end some distance from the continuous punch line 6.

As best evident from FIGS. 4 and 5 the lid panel 9 carries a sealing foil 12 at the lower edge. The sealing foil is attached to the bottom suface of the lid panel along a joining strip 13, extending round the entire continuous punching 6 and some distance both radially inwards and radially outwards of said continuous punching 6. The remaining parts of the sealing foil 12 is maintained free from the lid panel 9.

As best evident from FIG. 5 the joining strip or welding strip 13 provides a thickening of the sealing foil, especially along the line 14 corresponding to the continuous punching 6 of the lid panel, and said weekening line 14 provides a rupture indication along which the sealing foil is broken and sheared off when the container is opened.

From FIG. 4 is obvious that the end closure comprises a base material or a body 15, for instance of cardboard, which at the bottom surface carries a laminate of aluminum 16 and plastic 17, preferably a weldable resin like polyethylene and that the sealing foil comprises a plastic material 12. According to the invention the material of the sealing foil 12 should have a lower shear strength than the material of the body 15, with the aluminum-plasic laminate in order to guarantee that the sealing foil is broken before the end panel is broken.

As previously mentioned the end closure may be soft or hard and it may consist of any suitable material like plastic, paper, parchment, cardboard, hard plastic, sheet metal etc. In order to make a liquid and preferably even a gas proof container both the end closure 2 and the sealing foil 12 should be made of a liquid or gas proof material, for instance a laminate material of aluminum-plastic, and such an embodiment is shown in FIG. 5.

In a soft embodiment of a top closure both the top panel 3 and the sealing foil 12 may be of any plastic material and in a tested embodiment of the invention the top panel is made of polyesther and the sealing foil is made of a laminated material of aluminum and polyethylene.

It is of importance the punching 10 for the tearing tongue 11 leaves such distance 19 of the inner lid panel 9 that the lid panel can be torn off without the risk that the tearing tongue is broken away. In a lid panel made of a cardboard material and having a diameter of 9 cm it is quite sufficient that some few mm are left from the end of the tearing tongue punch 10 to the continuous opening punch line 6. In order to get a guarantee that the tearing tongue is not broken away the weld joining strip 13 may be extended by a portion 18 extending some distance inside the part of the lid panel 9 defined by the tearing tongue 11.

When opening the container the tearing tongue 11 is seized and is pulled straight up, whereby the sealing foil 12 is broken along the weekening line 14 provided along the continuous punching 6, and the sealing foil 12 is sheared of along a smooth line while being torn along the remaining support edge 7 of the top closure.

Figure 6:
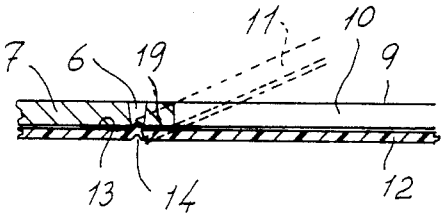
FIG. 6 illustrates a special effect which may be obtained in case the end panel is made of a stiff material like cardboard, plastic, plate metal or a similar material.

If the top closure is made of a stiff material like cardboard, stiff plastic, sheet metal or similar material a special effect can be obtained. When the tearing tongue 11 is seized and is lifted the oppositly extending part of the tongue is bent down as diagrammaticaly illustrated in FIG. 6, whereby said extended part of the tongue provides a breaking through of the weekening line 14, whereby the opening of the container is still more facilitated.

Figure 7:
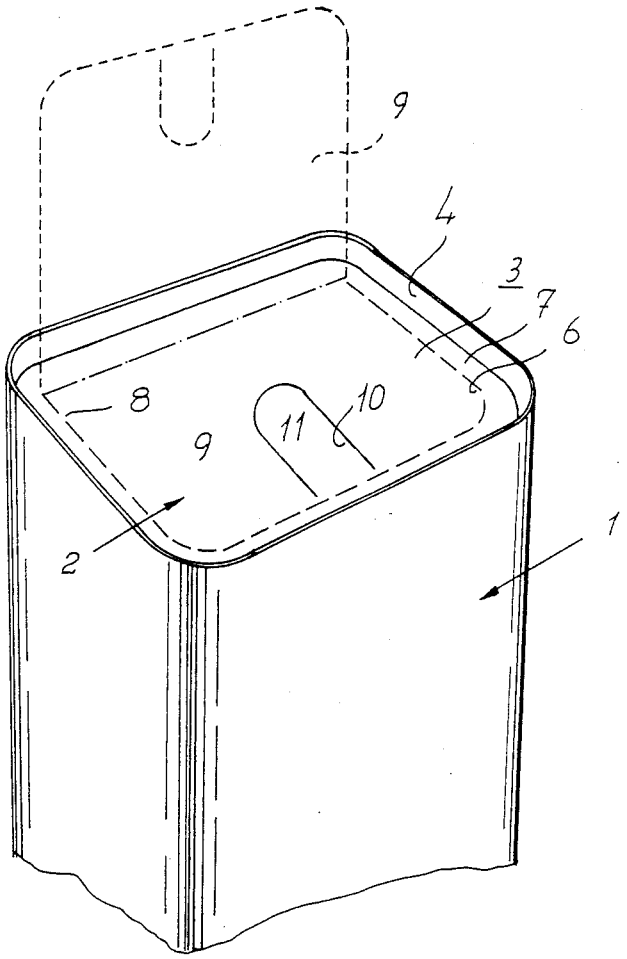
FIG. 7 shows a container in which the end closure provides a type of a reclosable protective lid.

FIG. 1 shows a top closing of a container having a circular cross section form. It is, however obvious that the container may have a rectangular or any other polygonal cross section form. It is also obvious that the top closing may be formed along only a part of the top line of the container as indicated in FIG. 7 and even only to provide a little pouring spout.

It is to be understood that the above description and the embodiments of the invention illustrated in the drawings are only illustrating examples and that many different modifications may be presented within the scope of the appended claims.

I claim:

1. Opening means for containers, especially powder proof, liquid proof or gas proof containers of the type which at least at one end is closed by means of an end closure (2) providing an openable and panel which for intance by means of a sealing edge (4) is sealingly connected to the container, characterized in that the end closure is punched through along a line (6) of the end panel (3) extending some distance inside of the sealing edge (4), in that the end panel (3) on the lower surface thereof carries a sealing foil (12) of a weldable or solderable material which is welded or soldered to the end panel (3) over a joining strip (13) so as to seal the through punching (6) of the end panel (3), in that the end panel (3) is made of a material having a higher shearing strength than that of the material of the lower sealing foil (12), and in that the end panel (3) is formed with means for forming an opening in the container by tearing open the end panel (3) and the sealing foil (12) along the through punching (6) of the end panel (3).

2. Opening means according to claim 1, characterized in that the end closure is stiff and that the end panel (3) is made of cardboard, stiff plastic, sheet metal or a similar material, and in that the sealing foil (12) is made of plastic, paper, parchment or a similar material.

3. Opening means according to claim 1, characterized in that the end panel is pliable and is made of plastic, paper, parchment or a similar material and in that the sealing foil is likewise pliable and is made of plastic, paper, parchment or similar material having a shearing strength which is less than that of the material of the end panel.

4. Opening means according to claim 1, characterized in that the end panel (3) is liquid proof and gas proof, whereby the end panel at the bottom surface thereof has a layer comprising a laminate of aluminum and plastic and in that the sealing foil (12) comprises a laminate of aluminum and plastic, whereby and plastic layers of the end panel (3) and the sealing foil (12) are facing each other.

5. Opening means according to claim 4, characterized in that the plastic material of the end panel (3) is an ether resin, a styrene resin or an esther resin, and in that the plastic material of the sealing foil (12) is an ethene resin, a polytetrafluorethene resin or a polyvinylchloride resin.

6. Opening means according to claim 1 or 2 or 3 or 4 or 5, characterized in that the end panel (3) is formed with a tearing tongue (11) provided substantially in the radial direction and in that the branches of the U-like through punching (10) ends at a place inside of the welded joining strip (13) but some distance from the continuous through punching (6) of the end panel (3).

7. Opening means according to claim 6, characterized in that the sealing foil (12) is secured to the end panel (3) along an integral joining strip, and in that an extended portion (18) of said joining strip (13) extend some distance into the part of the end panel (9) which is defined by the U-punching (10) of the tearing tongue (11).

* * * * *